US005621703A

United States Patent [19]

Kanesaka

[11] Patent Number: 5,621,703

[45] Date of Patent: Apr. 15, 1997

[54] RADIO WAVE-CORRECTED TIMEPIECE

[75] Inventor: Toshiya Kanesaka, Chiba, Japan

[73] Assignee: Seiko Instruments Inc., Japan

[21] Appl. No.: 346,900

[22] Filed: Nov. 30, 1994

[30] Foreign Application Priority Data

Dec. 1, 1993 [JP] Japan ..... 5-301807

[51] Int. Cl.[6] ..... G04C 11/02

[52] U.S. Cl. ..... 368/47

[58] Field of Search ..... 368/46–49, 51, 368/185–187; 455/51.1

[56] References Cited

U.S. PATENT DOCUMENTS

| | | | |
|---|---|---|---|
| 4,117,661 | 10/1978 | Bryant, Jr. | 368/47 |
| 4,204,398 | 5/1980 | Lemelson | 368/47 |
| 4,582,434 | 4/1986 | Plangger et al. | 368/46 |
| 4,823,328 | 4/1989 | Conklin et al. | 368/47 |
| 5,461,663 | 10/1995 | Motegi | 379/57 |

FOREIGN PATENT DOCUMENTS

| | | |
|---|---|---|
| 0374745 | 6/1990 | European Pat. Off. . |
| 0308881 | 3/1991 | European Pat. Off. . |
| 0455183 | 1/1992 | European Pat. Off. . |
| 2643250 | 3/1978 | Germany . |
| 4230531 | 11/1993 | Germany . |

*Primary Examiner*—Vit W. Miska
*Attorney, Agent, or Firm*—Adams & Wilks

[57] ABSTRACT

A radio wave-corrected timepiece permitting one to easily determine whether radio waves containing correct time data or radio waves containing abnormal time data are being received includes a receiver for receiving a broadcast time signal containing encoded time data and producing a rectangular pulse train containing encoded time data, a memory for storing pulse widths of the encoded data, a comparison circuit for comparing the output signal of the receiver with the output of the memory, and a processor for receiving the output of the comparison circuit, calculating the time, and providing an output permitting correction of a measured time.

18 Claims, 6 Drawing Sheets

RADIO WAVE-CORRECTED TIMEPIECE

BACKGROUND OF THE INVENTION

The present invention relates to a radio wave-corrected timepiece capable of extracting information about time from radio waves containing encoded information about the time and of correcting the time.

In a known structure as described in Japanese Patent Publication JP-B-61-191981(1986), received radio waves are converted into a pulse train, and an indicator or hand is moved in synchronism with the pulse train obtained by the conversion. In a radio timepiece of another known structure, the intensity of received radio waves is displayed, as described in U.S. Pat. No. 5,105,396.

However, in the first-mentioned prior art technique, a decision made as to whether the received radio waves are being jammed or in normal state depends on an operation consisting of watching an indicator or hand. Therefore, there is a possibility that the decision is made incorrectly.

The second-mentioned prior art technique has the problem that it is impossible to judge whether the received radio waves are being jammed or in normal state, although the intensity of the received radio waves can be known.

SUMMARY OF THE INVENTION

Accordingly, it is an object of the present invention to provide a radio wave-corrected timepiece capable of accurately correcting the time by judging that the radio waves are normal.

The above object is achieved in the present invention by a first structure in which rules for encoding of information about time are stored, and in which radio waves containing information about time are received. A pulse train containing the information about time is compared with the rules for encoding. In this way, jammed information is eliminated.

In a second structure, radio waves containing information about time are received. A pulse train containing the information about time is compared with rules for encoding. The results of the comparison are displayed. This enables one to judge whether received radio waves containing information about time are being jammed or not.

In a third structure, the period of time for which a receiving circuit is in operation is measured. This permits the time starting with reception to be measured.

In FIG. 1, oscillating means 130 generates a periodic signal. Dividing means 131 produces a signal having a frequency which is a submultiple of the frequency of the periodic signal from the oscillating means. Timing signal generating means 132 receives the output from the dividing means 131 and measures time. The time measured by the timing signal generating means 132 is displayed on first displaying means 133. Radio waves containing encoded information about time are received by an antenna 100, which converts the waves into an electrical signal. Receiving means 101 receives the output from the antenna 100 and produces a rectangular pulse train containing the encoded information about time. Rules of the encoded information about time are stored in memory means 102. Comparing means 103 compares the output from the memory means 102 with the output signal from the receiving means 101. Calculating means 104 receives the output from the comparing means 103 and calculates the time. The timing signal generating means 132 is corrected according to the output from the calculating means 104. Counting means 110 counts the output from the comparing means 103. The contents of the counting means 110 are displayed by a second displaying means 111. Measuring means 120 receives the output from the receiving means 101 and the output from the dividing means 131 and measures the time for which the receiving means 101 is in operation. The results of the measurement made by the measuring means 120 are displayed by a third displaying means 121.

That is, the present invention provides a radio wave-corrected timepiece capable of easily discriminating between jammed radio waves and normal radio waves.

DETAILED DESCRIPTION OF THE PREFERRED EMBODIMENTS

Embodiments of the invention are hereinafter described with reference to the drawings.

(1) First Embodiment

Figure 1:
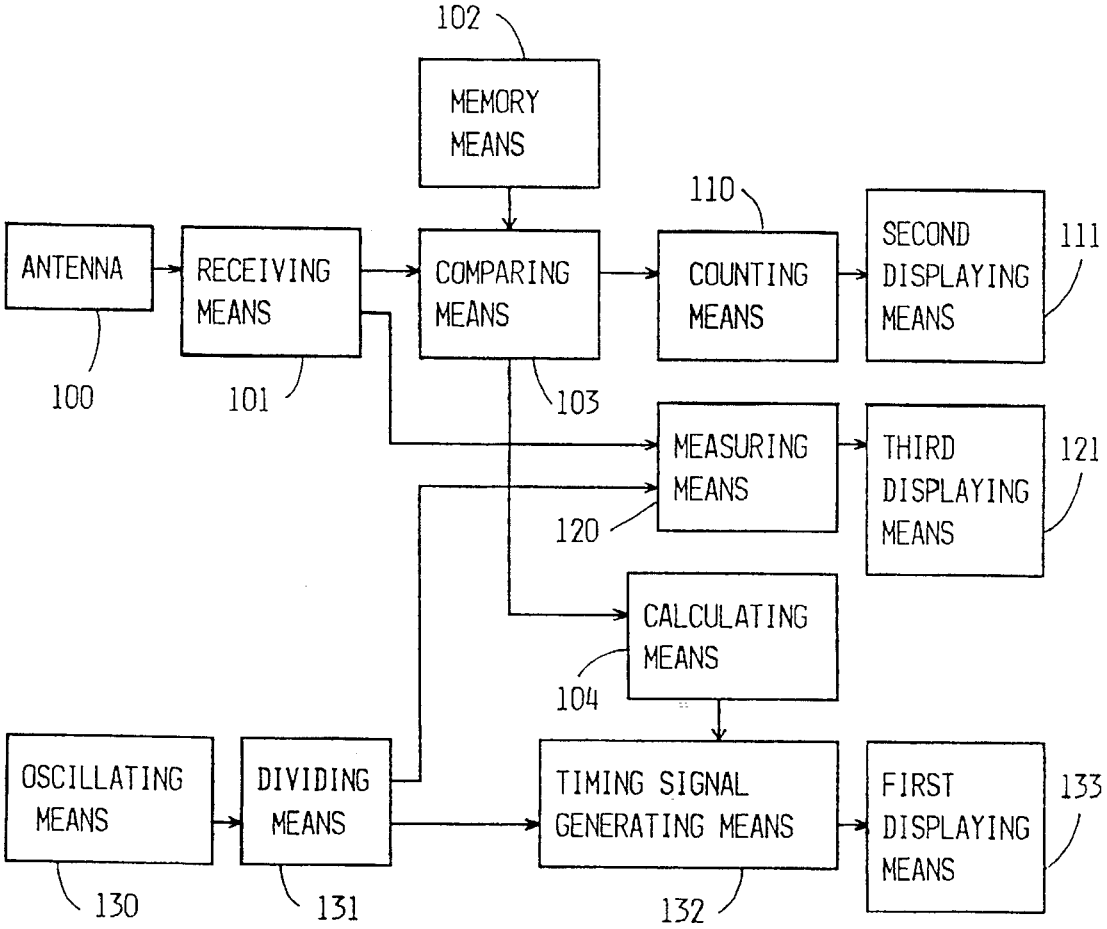
FIG. 1 is a block diagram showing one example of typical structure of a radio wave-corrected timepiece according to the invention.
Figure 2:
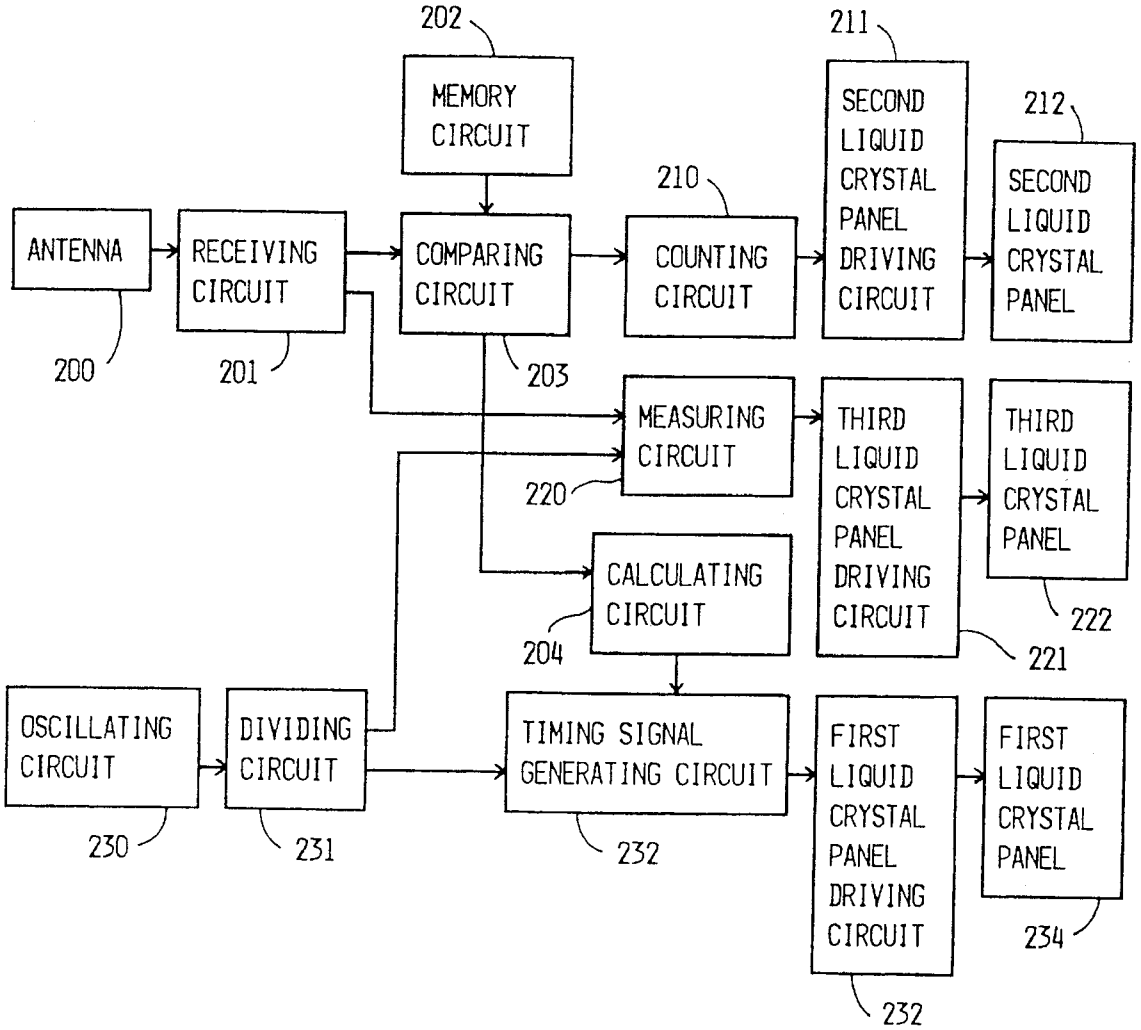
FIG. 2 is a block diagram showing a first embodiment of a radio wave-corrected timepiece according to the invention.

FIG. 2 is a block diagram of a first embodiment of a radio wave-corrected timepiece according to the present invention. Radio waves containing encoded information about time are received by an antenna 200. A receiving circuit 201 converts an electrical signal containing the encoded information about time into a pulse train containing the encoded information about time and delivers the pulse train as an output signal. A comparing circuit 203 compares the pulse train containing the encoded information about time with the contents of a memory circuit 202.

Figure 4:
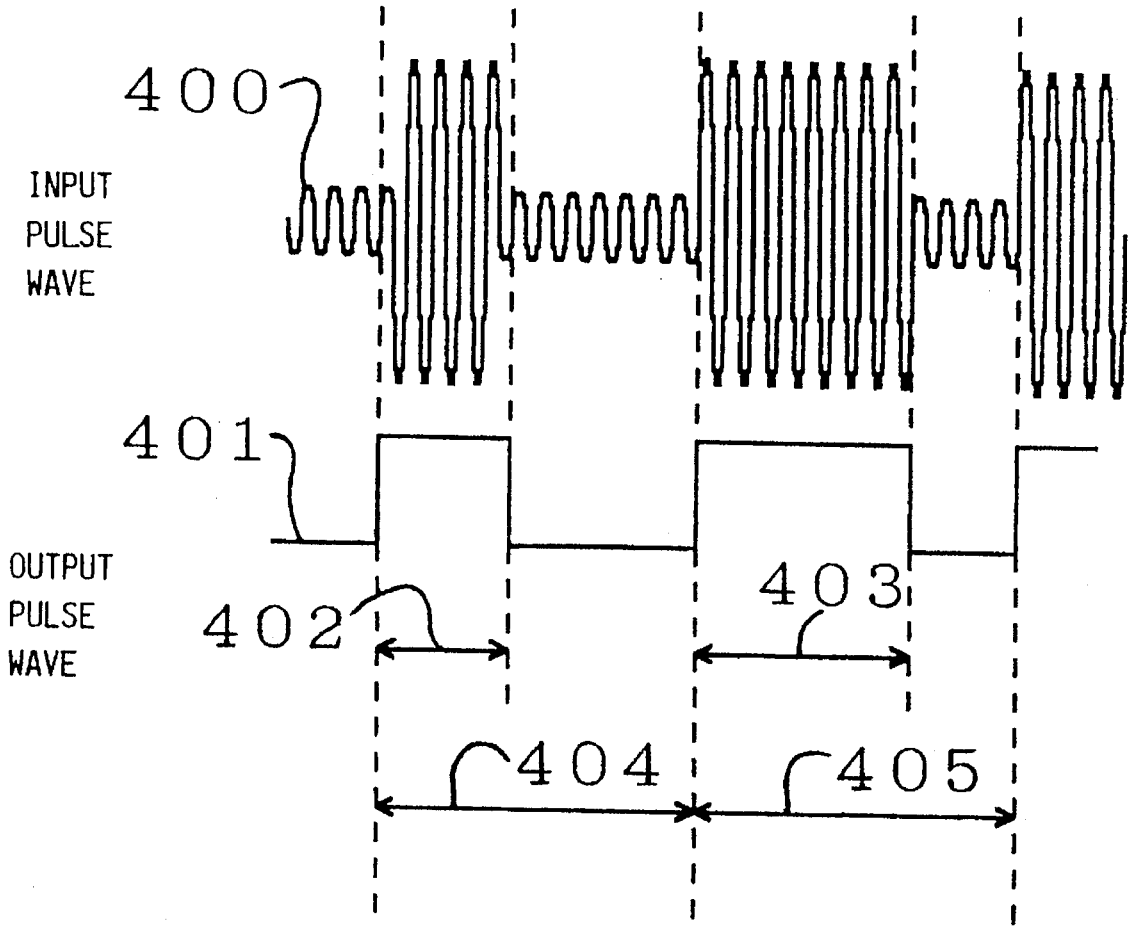
FIG. 4 is a diagram illustrating conversion of signals, showing one example of a radio wave-corrected timepiece according to the invention.

An example of a signal applied to the receiving circuit 201, an example of an output signal from the receiving circuit 201, and an example of contents compared by the comparing circuit 203 are now described by referring to FIG. 4. An input pulse wave 400 is an example of the signal applied to the receiving circuit 201. An output pulse wave 401 is an example of the signal from the receiving circuit 201. The input pulse wave 400 has a varying amplitude. The amplitude of the input pulse wave changes from a small value to a large value periodically. That is, periods of time 404 and 405 have the same length. When the amplitude of the input pulse wave 400 is large, it contains two kinds of periods, e.g., 402 and 403. That is, the period 404 can represent binary 1, while the period 405 can represent binary 0. Thus, it is possible to have binary notation. If variations in the amplitude are synchronized with changes in a second of time, then the second or other units of time can be represented. The input pulse wave 400 is converted into a rectangular pulse train so that the output pulse wave 401 can be treated easily by a digital circuit. The comparing circuit 203 can judge whether binary information are being applied and whether a signal is being applied periodically from the rectangular pulse train, by storing the lengths of the periods 404, 402, and 403 in the memory circuit 202.

Referring next to FIG. 2, an oscillating circuit 230 generates a periodic signal. A dividing circuit 231 produces a signal having a frequency which is a submultiple of the frequency of the periodic signal from the oscillating circuit 230. A timing signal generating circuit 232 receives the output signal from the dividing circuit 231 and measures time.

A calculating circuit 204 receives the output from the comparing means 203 and calculates the time. The results of calculation performed by the calculating circuit 204 are delivered to the timing signal generating circuit 232 so that time can be corrected.

Information about time counted by the timing signal generating circuit 232 is displayed on a first liquid crystal panel 234 by a first liquid crystal panel driving circuit 233.

A counting circuit 210 counts the results of comparison made by the comparing circuit 203. As an example, if the pulse train is normal, 1 is added. If the pulse train is not normal, 1 is subtracted. A second liquid crystal panel driving circuit 211 drives a second liquid crystal panel 212 to display the contents of the total count of the counting circuit 210.

Figure 6:
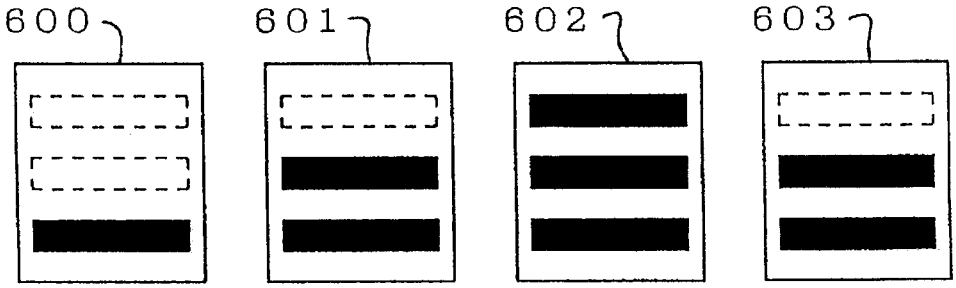
FIG. 6 is a sequence of displays, showing one example of a radio wave-corrected timepiece according to the invention.

For instance, the contents of the counting circuit 210 are displayed as shown in FIG. 6. When radio waves containing normal information about time are being received, the number of marks displayed are increased from display 600 to display 601 and then to display 602. When radio waves containing abnormal information about time are being received, the number of displayed marks is reduced such as from display 602 to display 603. By displaying the contents of the counting circuit 210 as described above, it is possible to judge whether radio waves containing normal information about time or radio waves containing abnormal information about time are being received.

In FIG. 2, a measuring circuit 220 receives the output from the receiving circuit 201 and the output from the dividing circuit 231 and measures the time of the state of the receiving circuit. As an example, the measuring circuit 220 counts the signal from the dividing circuit 231 during the period beginning with the start of operation of the receiving circuit 201 and ending with the end of operation of the receiving circuit 201. In this way, the time for which the receiving circuit 201 is in operation can be measured. A third liquid crystal panel driving circuit 221 drives a third liquid crystal panel 222 to display the contents of the measuring circuit 220. Since the operation time of the receiving circuit 201 is displayed, if extended reception is impossible, then the present location can be regarded as unsuitable for reception.

In the present embodiment, description is made, using liquid crystal panels. The method of providing a display with liquid crystal panels is merely one example. A display may be provided, using an indicator or hand, by driving a motor, instead of using liquid crystal panels. Furthermore, the liquid crystal displays may be replaced by any other display elements such as LEDs, ECDs, and ELs, and by sound sources such as loudspeakers.

Figure 7:
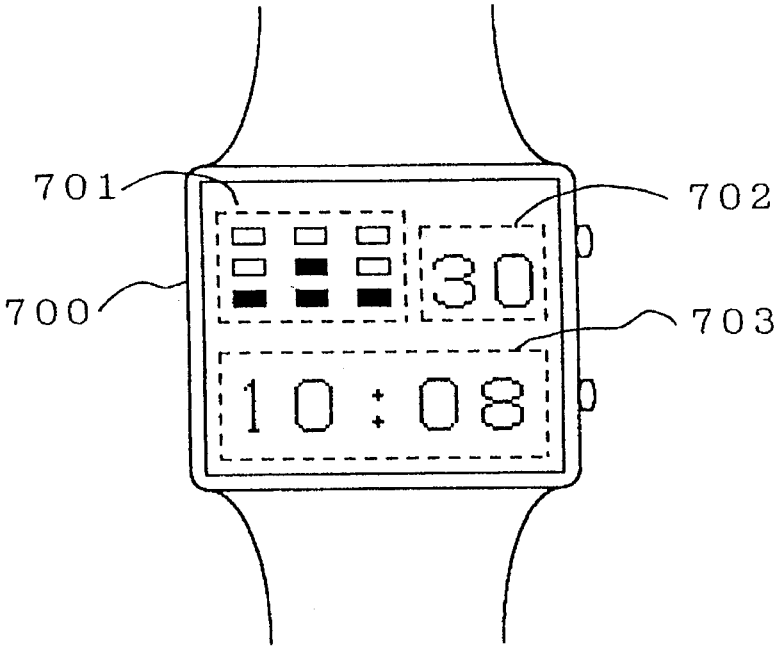
FIG. 7 is a perspective view showing one example of a radio wave-corrected timepiece according to the invention.

FIG. 7 is an example of a perspective view of the first embodiment of the present invention. A radio wave-corrected timepiece 700 has a time displaying portion 703 which displays time. A graphical display portion 701 displays the contents of the counting circuit 210. A displaying portion 702 displays the contents of the measuring circuit 220.

(2) Second Embodiment

Figure 3:
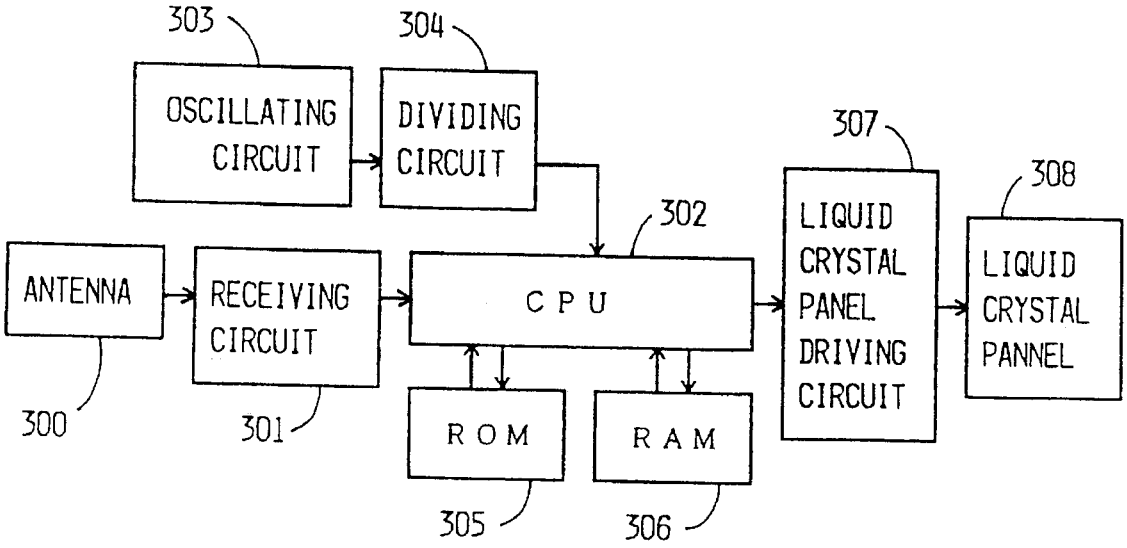
FIG. 3 is a block diagram showing a second embodiment of a radio wave-corrected timepiece according to the invention.

FIG. 3 is a block diagram of a second embodiment of a radio wave-corrected timepiece according to the present invention. The present embodiment is so constructed that it uses a CPU 302, a ROM 305, and a RAM 306. A program for controlling the CPU 302 is stored in the ROM 305.

Radio waves containing encoded information about time are received by an antenna 300. A receiving circuit 301 converts an electrical signal containing encoded information about time into a pulse train and produces it as an output signal. The CPU 302 compares the pulse train containing encoded information about time with the contents of the ROM 305. The results of the comparison are stored in the RAM 306. An oscillating circuit 303 generates a periodic signal. A dividing circuit 304 produces a signal having a frequency which is a submultiple of the frequency of the periodic signal from the oscillating circuit 303. The CPU 302 receives the output signal from the dividing circuit 304 and measures time. The results of counting are stored in the RAM 306.

The CPU 302 receives the output from the receiving circuit 301 and calculates the time from the pulse train containing information about time. The results of the calculation are stored in the RAM 306.

The CPU 302 measures inputs from the receiving circuit 301 and from the dividing circuit 304 and stores the operation time of the receiving circuit in the RAM 306.

A liquid crystal panel driving circuit 307 drives a liquid crystal panel 308 via the CPU 302 to display the storage contents of the RAM 306.

Figure 5:
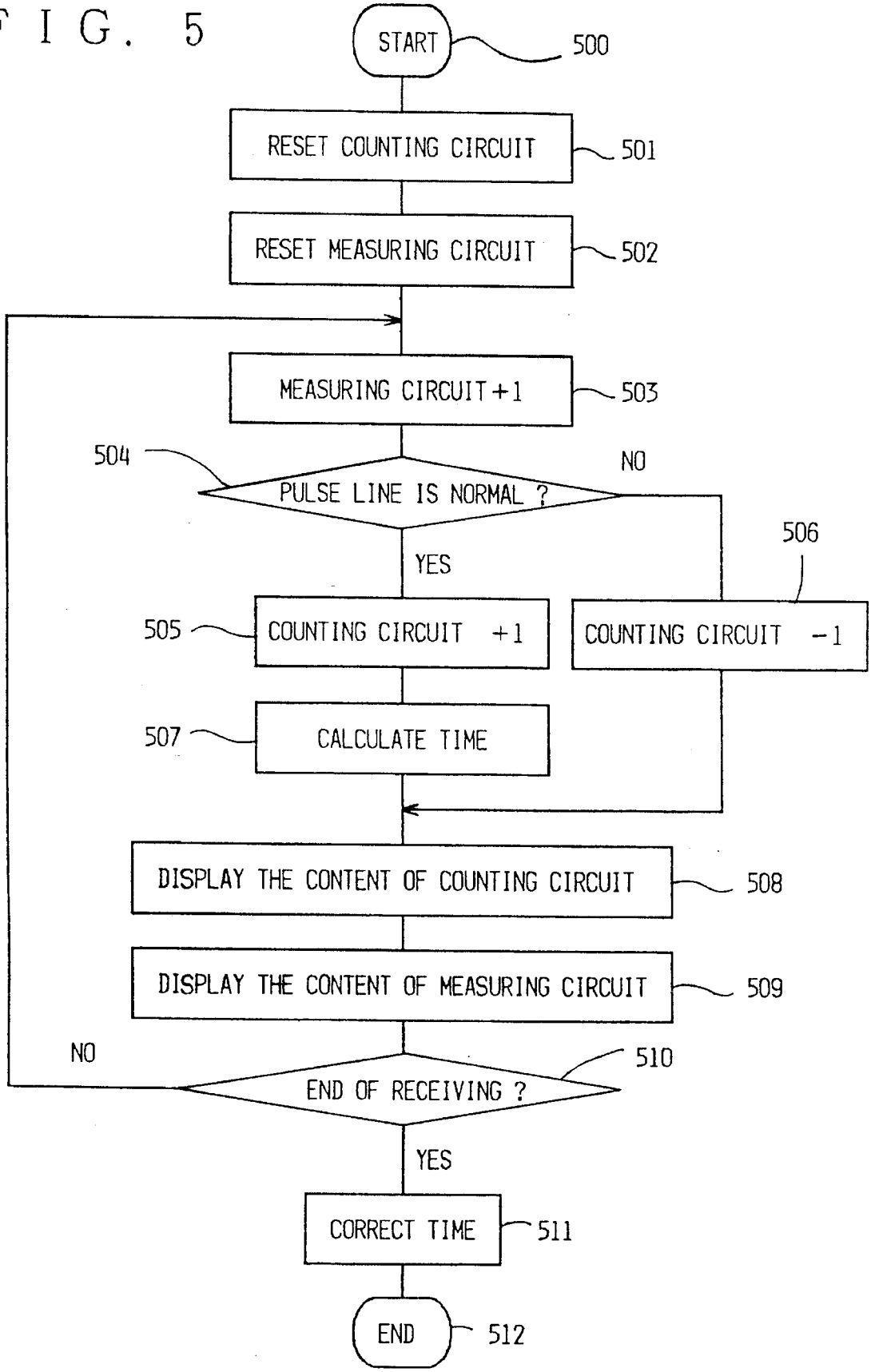
FIG. 5 is a flowchart illustrating one example of operation of the second embodiment of a radio wave-corrected timepiece according to the invention.

The operation of the CPU 302 when the timepiece is receiving is described next by referring to the flowchart of FIG. 5.

When reception is started, the operation is started (step 500).

The measuring circuit for performing a counting operation to judge whether radio waves containing normal information about time held in the RAM 306 or radio waves containing abnormal information about time are being received is reset (step 501).

The measuring circuit for measuring the time of the operation of the receiving circuit is reset (step 502).

The measuring circuit is incremented to count the time of operation of the receiving circuit 301 (step 503).

The rectangular pulse train containing information about time input to the CPU 302 is compared with the rules of the rectangular pulse train containing information about time stored in the ROM 305 (step 504).

If the result of the decision in step 504 is YES, then the counting circuit is incremented (step 505).

If the result of the decision in step 504 is NO, then the counting circuit is decremented (step 506).

The time is calculated from the rectangular pulse train containing information about time entered into the CPU 302, and is stored (step 507).

The liquid crystal panel driving circuit 307 displays the contents of the counting circuit stored in the RAM 306 on the liquid crystal panel 308, via the CPU 302 (step 508).

The liquid crystal panel driving circuit 307 displays the contents of the counting circuit stored in the RAM 306 on the liquid crystal panel 308, via the CPU 302 (step 509).

A decision is made as to whether the reception ends (step 510). If the reception does not yet end, control returns to step 503. If the reception ends, step 511 is carried out.

The time is corrected (step 511).

The operation is ended (step 512).

In the present embodiment, the description is made, using liquid crystal panels. The method of providing a display, using liquid crystal panels, is merely one example. A display may be provided, using an indicator or hand, by driving a motor, instead of using liquid crystal panels. Furthermore, the liquid crystal panels may be replaced by any other display elements and sound sources.

As described thus far, according to the present invention, a decision as to whether radio waves containing correct information about time or radio waves containing abnormal information about time are being received can be easily made, by counting the result of the output from a comparing circuit and displaying the count or by measuring the state of operation of a receiving circuit and displaying the results.

What is claimed is:

1. A radio wave-corrected timepiece comprising: oscillating means for generating a periodic signal; dividing means for producing an output having a frequency that is a submultiple of a frequency of an output from the oscillating means; timing signal generating means for receiving the output from the dividing means and counting time; first displaying means for displaying the time counted by the timing signal generating means; an antenna for receiving radio waves containing encoded time data; receiving means for receiving an output from the antenna and producing a pulse train containing the encoded time data; a memory for storing rules of the encoded time data; comparing means for comparing an output signal from the receiving means with an output from the memory; counting means for counting an output of the comparing means; second displaying means for displaying information representative of the count performed by the counting means; and calculating means for receiving an output from the comparing means and providing an output capable of correcting the time counted by the timing signal generating means.

2. A radio wave-corrected timepiece comprising: oscillating means for generating a periodic signal; dividing means for producing an output having a frequency that is a submultiple of a frequency of an output from the oscillating means; timing signal generating means for receiving the output from the diving means and counting time; displaying means for displaying the time counted by the timing signal generating means; an antenna for receiving radio waves containing encoded time data and outputting a corresponding electrical signal; receiving means for receiving an output from the antenna and producing a pulse train containing the encoded time data; measuring means for receiving an output from the receiving means and an output from the dividing means and counting a time during which the receiving means is in operation; another displaying means for displaying an output from the measuring means; a memory for storing rules corresponding to the encoded time data; comparing means for comparing an output signal from the receiving means with an output of the memory; and calculating means for receiving an output of the comparing means and providing an output capable of correcting the time counted by the timing signal generating means.

3. A radio wave-corrected timepiece comprising: receiving means for receiving a broadcast encoded time signal; calculating means for comparing the pulse width of selected pulses of encoded time data included in the time signal received by the receiving means with pre-stored pulse width data and for calculating the time from results of the comparison; an internal time standard for producing a time signal; timing signal generating means for measuring time according to the time signal; means for correcting the time measured by the timing signal generating means according to results of the calculation performed by the calculating means; and displaying means for displaying the time.

4. A timepiece according to claim 3; wherein the displaying means comprises first displaying means for displaying the time measured by the timing signal generating means and corrected by the means for correcting.

5. A timepiece according to claim 4; wherein the first displaying means comprises a liquid crystal display panel and a liquid crystal display panel driving circuit for driving the liquid crystal display panel in accordance with an output of the timing signal generating means and an output of the means for correcting.

6. A timepiece according to claim 3; further comprising counting means for counting an elapsed time during which the receiving means receives a broadcast time signal.

7. A timepiece according to claim 6; further comprising second displaying means for displaying the elapsed time during which the receiving means receives a broadcast time signal.

8. A timepiece according to claim 7; wherein the second displaying means comprises a liquid crystal display panel and a liquid crystal display panel driving circuit for driving the liquid crystal display panel in accordance with an output of the counting means.

9. A timepiece according to claim 3; wherein the receiving means includes an antenna for receiving the broadcast time signal and producing a corresponding electrical output signal and a receiver for receiving the electrical output signal and producing a pulse train output corresponding to time data encoded in the broadcast time signal.

10. A timepiece according to claim 3; wherein the calculating means includes means for counting the results of the pulse width comparison and producing a corresponding count; and the displaying means includes means for displaying the count.

11. A timepiece comprising: first means for measuring time in accordance with an internal time standard; second means for measuring time in accordance with a broadcast time signal; and means for correcting the time measured by the first means in accordance with the time measured by the second means; wherein the second means includes a memory for storing pulse width information corresponding to time data encoded in the broadcast time signal, and means for verifying a received time signal by comparing the pulse width of respective pulses of data in the time signal with pulse width information stored in the memory.

12. A timepiece according to claim 11; further comprising first display means for displaying the time measured by the first means.

13. A timepiece according to claim 12; wherein the first display means comprises a liquid crystal display panel and a liquid crystal display panel driving circuit for driving the liquid crystal display panel in accordance with an output of the first means and an output of the means for correcting.

14. A timepiece according to claim 11; further comprising counting means for counting the results of the pulse width comparison; and display means for displaying the count.

15. A timepiece according to claim 14; further comprising second display means for displaying the elapsed time during which the means for verifying detects a received time signal.

16. A timepiece according to claim 15; wherein the second display means comprises a liquid crystal display panel and a liquid crystal display panel driving circuit for driving the liquid crystal display panel in accordance with an output of the counting means.

17. A timepiece according to claim 11; wherein the second means for measuring time includes an antenna for receiving a broadcast time signal and producing a corresponding electrical output signal, and a receiver for receiving the electrical output signal and producing a pulse train output corresponding to time data encoded in the broadcast time signal.

18. A timepiece according to claim 17; further comprising measuring means for measuring a time duration during which the receiver outputs the pulse train; and display means for displaying the time duration.

* * * * *